United States Patent [19]

Branen et al.

[11] 4,135,035

[45] Jan. 16, 1979

[54] LAMINATED COMPOSITE GOLF CLUB SHAFT

[75] Inventors: Kenneth E. Branen, Hudson; Gall, John J., Salem, both of N.H.

[73] Assignee: Avco Corporation, Wilmington, Mass.

[21] Appl. No.: 852,777

[22] Filed: Nov. 18, 1977

Related U.S. Application Data

[63] Continuation-in-part of Ser. No. 688,338, May 20, 1976, abandoned.

[51] Int. Cl.[2] ..... A63B 53/10; D02G 3/00

[52] U.S. Cl. ..... 428/377; 273/80 B; 273/80 R; 273/DIG23; 428/364; 428/366; 428/367

[58] Field of Search ..... 428/365, 366, 367, 377, 428/364; 273/80 B, 81.5, 81.6, DIG. 23; 156/170, 173, 175, 177, 180, 184, 195

[56] References Cited

U.S. PATENT DOCUMENTS

| | | | |
|---|---|---|---|
| 2,934,345 | 4/1960 | Scott | 273/80 B |
| 3,281,299 | 10/1966 | Shobert | 156/175 |
| 3,429,758 | 1/1967 | Young | 428/377 X |
| 3,442,738 | 5/1969 | Scott et al. | 156/180 X |
| 3,491,999 | 1/1970 | Lindler | 273/80 B |
| 3,929,543 | 12/1975 | Scott et al. | 156/172 X |
| 3,974,012 | 8/1976 | Hogarth | 273/DIG. 23 X |
| 3,998,458 | 12/1976 | Inoue et al. | 273/DIG. 23 X |
| 4,000,896 | 1/1977 | Lauraitis | 273/DIG. 23 X |
| 4,023,801 | 5/1977 | Van Auken | 273/DIG. 23 X |

FOREIGN PATENT DOCUMENTS

| | | | |
|---|---|---|---|
| 1261541 | 1/1972 | United Kingdom | 273/DIG. 23 |
| 1349906 | 4/1974 | United Kingdom | 273/DIG. 23 |
| 1351732 | 5/1974 | United Kingdom | 273/DIG. 23 |

*Primary Examiner*—Lorraine T. Kendell
*Attorney, Agent, or Firm*—Abraham Ogman

[57] ABSTRACT

The invention covers a laminated composite shaft formed by blending composite materials having high-bending modulus reinforcements with materials having a lesser or intermediate bending modulus. The shaft comprises a plurality of windings superimposed one upon the other. The windings having reinforcements with a high-bending modulus are sandwiched in between windings having reinforcements with an intermediate bending modulus. The orientation of the reinforcements within the composite materials in relation to the axis of the shaft are disclosed.

6 Claims, 3 Drawing Figures

LAMINATED COMPOSITE GOLF CLUB SHAFT

This application is a Continuation-in-Part of application Ser. No. 688,338, filed May 20, 1976, and now abandoned.

INTRODUCTION

With the advent of filaments which exhibit extremely high bending moduli and strength, such as filaments made from boron, silicon carbide, carbon and certain oxides, industry has begun to substitute reinforced composites for metals and wood. The substitution of composites for metals and wood offers particularly significant advantages in those applications which require a high-strength-to-weight ratio or a high-bending modulus-to-weight ratio. Among the first applications for such materials appeared the construction of shafts, and composite golf club shafts, in particular. The goal generally, is to provide the stiffest, lightest shaft possible.

DEFINITIONS

For purposes of this discussion, a composite material is defined as a material having substantially continuous unidirectional reinforcing filaments incorporated within a matrix material. The matrix material for minimizing weight is generally a plastic material such as an epoxy, polyester, phenolic, etc. The filaments may be incorporated in a single layer or in multiple layers.

The term "about" when used in connection with quantitative values, shall mean that slight deviation from these values can be tolerated.

Intermediate bending modulus is defined as 16–40 million pounds per square inch.

High-bending modulus is defined as 40 million pounds per square inch and higher.

A laminated composite shaft is generally made by winding successive layers of composite tape material around a mandrel. Such a structure is shown in FIG. 1. When a plastic matrix material is used, the tape is generally "B" staged or partially cured. After all the windings are applied, the resin matrix is fully cured, generally on the application of heat and pressure to form a unitary shaft.

There are no known measurement standards for golf club shafts. The quality of a club is still largely subjective. Generally, a golfer wants the lightest shaft with as little transverse bending (very stiff) as possible.

Golf club shafts have been produced exclusively with high-modulus filaments. These are very expensive. Shafts have been constructed with a blend of high-modulus and intermediate-modulus filaments. The high-modulus filaments are generally oriented longitudinally, and the intermediate-modulus filaments oriented angularly to the axis of the shaft.

The problem of providing low-cost, light-weight and very stiff shafts was solved with the foregoing design. While performance improved, complaints persisted, which eventually led Applicants to conclude rotational torques, resulting from the ball striking a club, were now limiting performance.

The principal object of the invention is to provide a low-cost, stiff and light laminated composite golf club shaft that also limits transverse torsional effects.

Another object of the invention is to provide a laminated composite golf club shaft which includes efficient use of very expensive high-modulus filament reinforcements.

In accordance with the invention, a composite shaft comprises a first composite material having filaments with a bending modulus of at least 40 million pounds per square inch. The first composite material is sandwiched between a second composite material having filaments with a bending modulus of 16–40 million pounds per square inch. A portion of the filaments of the first composite are oriented longitudinally along the length of the shaft. Additional layers of the first composite material contain reinforcement filaments angularly displaced relative to the axis of the shaft. The filaments of the second composite are angularly displaced relative to the axis of the axis of the shaft.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

Figure 1:
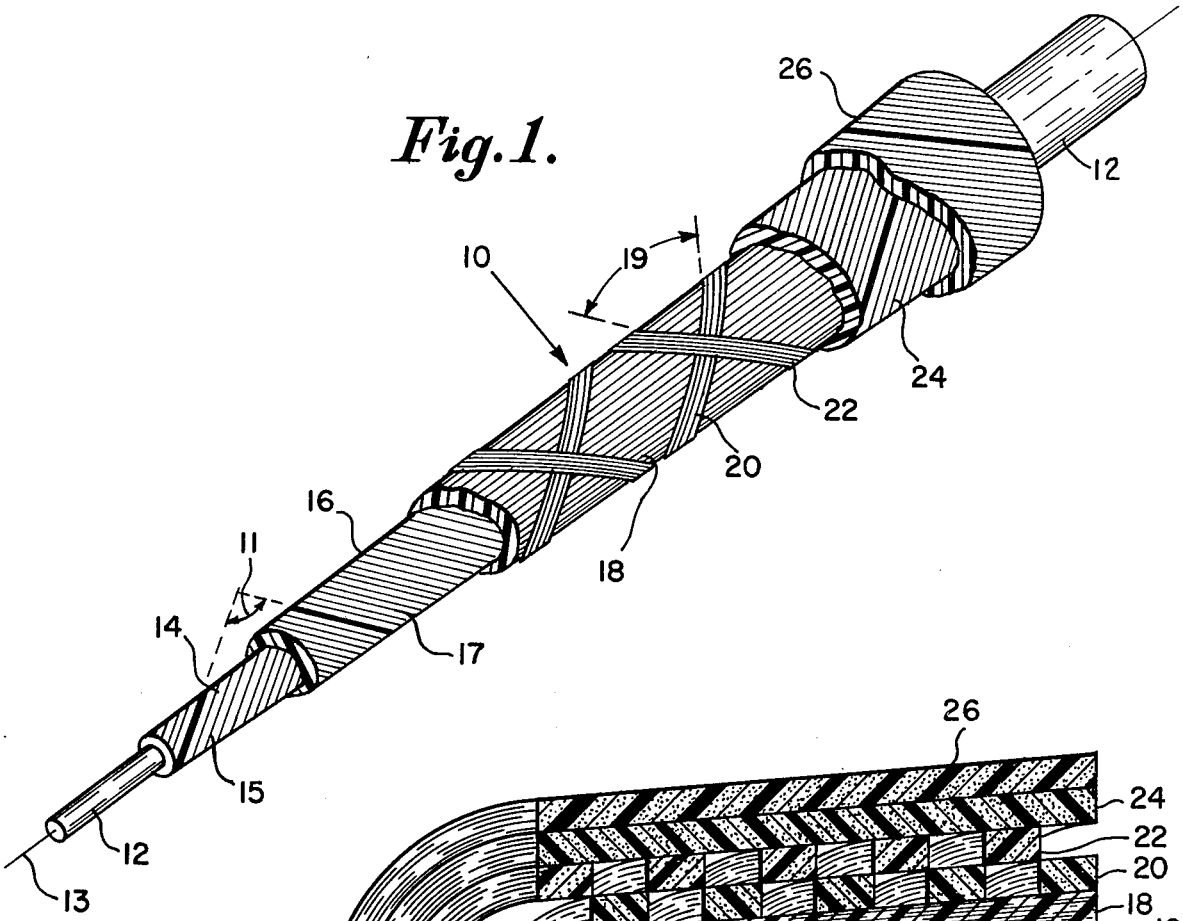
FIG. 1 is a partially cut away view of a shaft incorporating the principles of the present invention.

Referring to FIG. 1 of the drawings, there is shown a laminated composite golf club shaft 10 situated on a mandrel 12 shown in phantom outline. The axis of the mandrel 12 and consequently of the shaft 10 is identified by the number 13.

Figure 3:
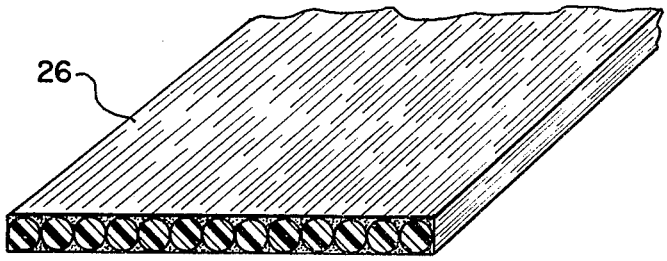
FIG. 3 is a partial pictorial of a composite tape containing a single layer of filament reinforcements.

In accordance with the invention, a layer 14 of composite material is wound on the mandrel 12. The preferred composite structure is a tape about 5–7 mils thick with a single layer of filaments. See FIG. 3. The reinforcing filaments 15 are angularly displaced from the axis 13 about 45° ± 10°. The shaft winding 14 covers the entire surface of the mandrel 12. The filaments 15 may be made from any material having a bending modulus of about 16–40 million pounds per square inch. The preferred candidate material is an aramid filament that is sold under the tradename Kevlar 49. Some forms of glass and ceramic filaments would qualify, except that the weight of glass and ceramic are generally much greater than the weight of the aramid filament. A layer 16 of composite material also comprises a winding having filaments with a bending modulus of about 16–40 million pounds per square inch. Winding 16 is similar to winding 14, in that the reinforcing filaments 17 of winding 16 are oriented about 45° ± 10° with respect to the axis 13, but these are wound in a direction opposite to the direction that the filaments 15 are oriented. In other words, the filaments 15 and 17 are oriented about 90° relative to one another. See angle 11.

The layer 16 covers the entire surface of the layer 14.

Another composite layer 18 is superimposed over layer 16 and includes reinforcing filaments 19 that are oriented longitudinally parallel to the surface of layer 16. The filaments 19 that make up the reinforcements of the layer 18 are formed from materials having a bending modulus in excess of 40 million pounds per square inch. These filaments may be formed from silicon carbide, carbon or boron. Boron is preferred because it is more durable than carbon filaments and less costly than carbon and silicon carbide filaments.

The structure of the shaft 10 continues with a pair of layers 20 and 22 of composite material. Layer 20 comprises a relatively narrow tape of composite material having reinforcing filaments with a bending modulus in excess of 40 million pounds per square inch. The filaments in layer 20 are oriented about 20° ± 10° relative to the axis 13 of the shaft 10 and the mandrel 12. Layer 22 is similar to layer 20. The reinforcing filaments are displaced a like amount relative to the axis 13 but the tape is wound in an opposite direction so that the filaments in layer 20 and the filaments in layer 22 are angularly displaced from one another from 120°–160°. See angle 19. Layers 20 and 22 do not cover the complete surface of layer 18. In the preferred construction, the width of tapes forming layers 20 and 22 is ¾ of an inch. Each cover from 50 to 75 percent of the surface of layer 18 for a shaft having a maximum diameter of 1½ inches.

Layers 24 and 26, respectively, are similar to layers 14 and 16. They are constructed over the layers 22 and comprise the last two layers of the shaft 10. The reinforcing filaments within layers 24 and 26 follow the orientation of the filaments in layers 14 and 16, respectively.

Figure 2:
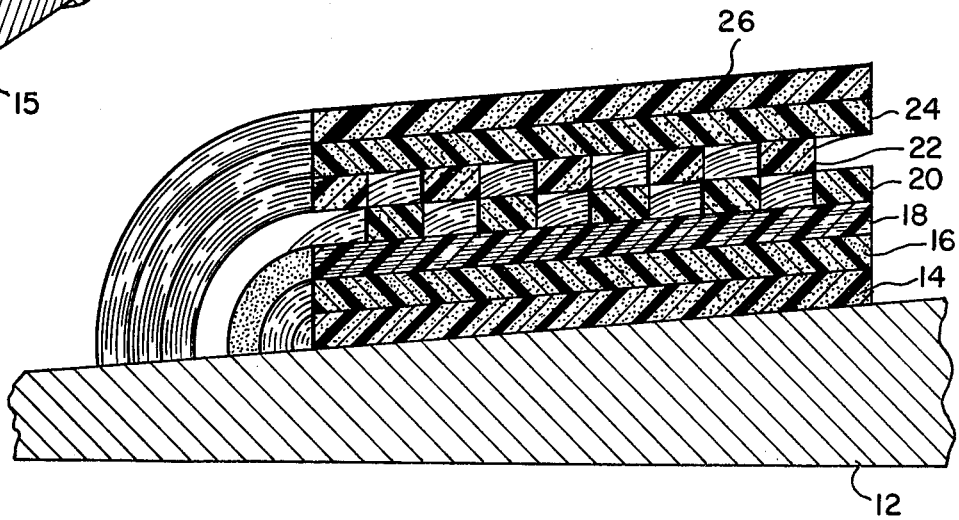
FIG. 2 is a section of the segment of the FIG. 1 shaft depicting the multi-layer laminate structure.

Referring to FIG. 2, there is a partial section of the shaft 10 depicting the seven layers described in detail above. It will be noted that layers 20 and 22 do not cover the entire surface of the preceding layers, whereas layers 14, 16, 18, 24, and 26, do.

The choice of filaments coupled with the filament orientation associated with each layer are the most important factors contributing to producing a golf club shaft providing performance superior to existing clubs on the market. The disclosed arrangement represents an optimum configuration for the viewpoint of providing the user with a club that is as light as existing composite clubs, and probably as stiff. There is, however, a discernable improvement in resistance to torsional effects, without noticeable deterioration in stiffness, stemming from the angular displacement of the high-modulus filaments.

While opinions may vary as to the qualities of a good to excellent golf club shaft, there is virtual unanimity on the desirability of having a light weight and stiff shaft at a manageable cost. Medium to high modulus composite materials are costly.

The described concept of using both high-modulus and medium-modulus reinforcing filaments in the described configuration achieves these objectives.

The inventive concept is dependent on the use of inner and outer wrappers or layers of a medium-modulus composite having high-modulus intermediate layers of a high-modulus composite material. The high-modulus layers include at least one layer with reinforcing filaments oriented parallel to the axis of the shaft and at least one layer with reinforcing filaments wrapped at angles relative to the axis of the shaft.

In summary the invention is directed to the combined use of composite materials having reinforcing filaments with an intermediate bending modulus and composite materials with reinforcing filaments having a high-bending modulus in a specific configuration. The intermediate composite material is to be found in the inner and outer wrappers of the laminate, and the high-modulus composite forms an intermediate filler between the inner and outer wrappers.

The inner and outer wrappers each have at least one layer of composite material. The reinforcing filaments therein are angularly displaced relative to the axis of the shaft. In FIG. 1 the inner wrapper comprises layers 14 and 16, while the outer layers comprise layers 24 and 26.

The intermediate filler comprises at least one layer of composite material with its reinforcing filaments oriented parallel to the axis of the shaft such as at 18 and a second layer of composite material having its reinforcing filaments oriented angularly with respect to the axis of the shaft such as either 20 or 22.

The filler layer(s) with reinforcing filaments angularly displaced relative to the axis of the shaft do not cover the entire surface of the layer below. The filler layer with filaments oriented longitudinally, i.e., parallel to the axis of the shaft may or may not cover the surface on which it is placed. Successive layers are wound over the surfaces created by the next inner layer as is apparent from FIG. 1.

The structure depicted in the drawings is a preferred embodiment. Although the preferred configuration of the inner and outer wrappers includes two layers each, a single layer in each of the inner and outer wrappers can suffice. Also while the composite materials depicted in FIG. 1 contain a monolayer of filaments, this is not a limitation, as was previously mentioned in the definitions on page 2.

Similarly, the preferred embodiment shows a single layer of composite material having its reinforcing filaments oriented parallel to the axis of the shaft. A single layer is not as important as having a combination of at least two composite layers of high-modulus filament where one layer has its reinforcing filaments oriented parallel to the axis of the shaft while a second layer has its reinforcing filaments angularly displaced relative to the axis of the shaft.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A laminated composite golf club shaft comprising a first composite winding having at least two composite layers, each such composite layer having a single layer of filaments, the filaments in adjacent layers being wound in opposite directions;

a second composite winding covering said first composite winding having filaments oriented longitudinally parallel to the surface formed by said first composite winding;

a third composite winding superimposed over said second composite winding having at least two layers of composite materials which do not cover the surface formed by said longitudinal winding, each of said layers having a single layer of filaments, the filaments in adjacent layers being wound in opposite directions; and a fourth composite winding superimposed over the third composite winding, said fourth composite winding being similar in structure to said first composite winding and covering the entire surface of said third composite winding.

2. A shaft as defined in claim 1 wherein the first and fourth composite windings have filaments in adjacent layers oriented 35°–55° relative to the axis of the shaft

3. A shaft as defined in claim 2 wherein the filaments in the adjacent layers of the third composite winding are angularly displaced 10°–30° relative to the axis of the shaft.

4. A shaft as defined in claim 1 wherein the bending modulus of the filaments in the first and fourth composite windings is 16,000,000–24,000,000 pounds per square inch and the bending modulus of the filaments in the second and third composite windings is 40,000,000 pounds per square inch.

5. A shaft as defined in claim 4 wherein the layers in the third composite winding cover 50–75% of the surface formed by the second composite winding.

6. A laminated composite golf club shaft comprising:

an inner wrapper having at least one layer of composite material, the reinforcing filaments of the composite material having an intermediate bending modulus and being angularly displaced relative to the axis of the shaft;

an outer wrapper having at least one layer of composite material, the reinforcing filaments of the composite material having an intermediate bending modulus and being angularly displaced relative to the axis of the shaft; and an intermediate composite filler having at least one layer with its reinforcing filaments oriented parallel to the axis of the shaft and a second filler material situated on the surface formed by the first layer, said second filler layer having its reinforcing filaments angularly displaced relative to the shaft, the reinforcing filaments in the intermediate composite filler having a high-bending modulus.

* * * * *